US011940172B2

(12) United States Patent
Awasthi et al.

(10) Patent No.: US 11,940,172 B2
(45) Date of Patent: Mar. 26, 2024

(54) DIFFUSER OF AN HVAC SYSTEM

(71) Applicant: Air Distribution Technologies IP, LLC, Milwaukee, WI (US)

(72) Inventors: Mayank Awasthi, Pune (IN); Vikas H. Dhote, Pune (IN); Tushal Verma, Mathura (IN); Curtis A. Peters, The Woodlands, TX (US); Sethuram Parameswaran, Kochi (IN)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 769 days.

(21) Appl. No.: 16/261,192

(22) Filed: Jan. 29, 2019

(65) Prior Publication Data

US 2020/0018515 A1 Jan. 16, 2020

Related U.S. Application Data

(60) Provisional application No. 62/697,282, filed on Jul. 12, 2018.

(51) Int. Cl.
*F24F 13/072* (2006.01)
*F24F 13/14* (2006.01)

(52) U.S. Cl.
CPC ..... *F24F 13/072* (2013.01); *F24F 13/1413* (2013.01)

(58) Field of Classification Search
CPC .... F24F 13/075; F24F 13/1413; F24F 13/072; B21D 39/031; B21D 39/048;
(Continued)

(56) References Cited

U.S. PATENT DOCUMENTS 2,144,646 A * 1/1939 Zalkind ..... A47B 96/20 52/630
2,352,876 A * 7/1944 Wilson ..... F16L 59/12 285/55

(Continued)

FOREIGN PATENT DOCUMENTS

CN 2208191 Y * 1/2013
EP 3410028 A1 * 12/2018 ..... F24F 13/06
JP 2004293821 A * 10/2004

OTHER PUBLICATIONS

Nailor Industries Inc.; "Plenum Slot Diffuser Supply • Adjustable "Ice Tong" Pattern Controllers Model: 5850, 5875 and 5810"; p. 1.

(Continued)

*Primary Examiner* — Edelmira Bosques
*Assistant Examiner* — Frances F. Hamilton
(74) *Attorney, Agent, or Firm* — Fletcher Yoder, PC

(57) ABSTRACT

A plenum slot diffuser includes a plenum box having five walls formed by joining edges of a C-shaped bracket having first, second, and third walls of the five walls with additional edges of an L-shaped bracket having fourth and fifth walls of the fives walls. An air input opening of the plenum box is disposed in one of the five walls and is configured to be coupled to a duct, and an open end of the plenum box defines an air output opening. The plenum slot diffuser includes at least one blade and a blade holding rod comprising a neck, wherein the neck faces away from the air output opening of the plenum box.

24 Claims, 8 Drawing Sheets

(58) Field of Classification Search
CPC .... B21D 39/044; B21D 39/03; B21D 39/032; B65D 7/06
USPC ..... 454/319, 301–304; 392/352, 353; 72/176
See application file for complete search history.

(56) References Cited

U.S. PATENT DOCUMENTS 2,916,181 A * 12/1959 Pfister ..... F16B 17/008 220/62
3,185,068 A * 5/1965 Straub ..... F24F 13/072 454/304
3,295,432 A * 1/1967 Palmquist ..... F24F 13/072 454/304
3,338,599 A * 8/1967 Hallman ..... H02G 3/0608 285/284.1
3,412,669 A * 11/1968 Averill ..... F24F 13/072 454/304
3,757,665 A * 9/1973 Coplin ..... F24F 13/0236 454/284
3,811,369 A * 5/1974 Ruegg ..... F24F 13/072 454/304
3,848,799 A * 11/1974 Day ..... F24F 13/068 251/303
3,918,354 A * 11/1975 Lambert ..... F24F 13/072 454/304
3,985,068 A * 10/1976 Herb ..... F24F 13/20 454/301
4,008,653 A * 2/1977 Tatham ..... F24F 13/072 454/303
4,102,557 A * 7/1978 Lee ..... F16B 12/30 312/257.1
4,491,062 A * 1/1985 Sylvester ..... F24F 13/072 454/303
4,499,815 A * 2/1985 Burkarth ..... B60H 1/00371 454/301
4,734,971 A * 4/1988 Dupasquier ..... B21D 39/03 138/166
5,095,942 A * 3/1992 Murphy ..... F16L 9/003 137/561 A
5,141,473 A * 8/1992 Swaney ..... F24F 13/072 454/301
5,194,042 A * 3/1993 Clark ..... F24F 13/072 454/304
5,839,848 A * 11/1998 Sahramaa ..... F16B 17/00 403/382
5,957,506 A * 9/1999 Stepp ..... F24F 13/0281 285/183
6,231,704 B1 * 5/2001 Carpinetti ..... F16L 9/003 138/149
6,280,321 B1 * 8/2001 Jones ..... F24F 13/072 454/301
6,290,598 B1 * 9/2001 Jones ..... F24F 13/20 454/303
6,311,735 B1 * 11/2001 Small, Sr. ..... F16L 9/003 138/109
6,386,970 B1 * 5/2002 Vernier ..... F24F 13/072 454/303
6,537,146 B1 * 3/2003 Haynes ..... F24F 13/15 454/290
7,964,794 B2 * 6/2011 Chung ..... H02G 3/126 174/58
8,517,058 B1 * 8/2013 Santeler ..... F16L 43/003 138/39
10,190,797 B2 * 1/2019 Gray ..... F24F 13/24
2009/0286464 A1 * 11/2009 Sanchez ..... F24F 13/06 454/367
2012/0052790 A1 * 3/2012 Abramian ..... F24F 13/072 454/304

OTHER PUBLICATIONS

Donco Air Products; "Air Distribution Submittal"; pp. 1-2.
Titus; "Plenum Slot Adjustable Diffusers (continued)" p. 1.
Price Industries Limited; "T-Bar Diffuser"; pp. 1-34.

* cited by examiner

DIFFUSER OF AN HVAC SYSTEM

CROSS REFERENCE TO RELATED APPLICATIONS

This application claims priority from and the benefit of U.S. Provisional Application Ser. No. 62/697,282, entitled "DIFFUSER OF AN HVAC SYSTEM," filed Jul. 12, 2018, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

The present disclosure relates generally to a heating, ventilation, and/or air conditioning (HVAC) system, and more particularly to a diffuser or duct outlet of an HVAC system.

A wide range of applications exist for HVAC systems. For example, residential, light commercial, commercial, and industrial systems are used to control temperatures and air quality in residences and buildings. Generally, HVAC systems may circulate a fluid, such as a refrigerant, through a closed loop between an evaporator coil, where the fluid absorbs heat, and a condenser, where the fluid releases heat. The fluid flowing within the closed loop is generally formulated to undergo phase changes within the normal operating temperatures and pressures of the system, so that quantities of heat can be exchanged by virtue of the latent heat of vaporization of the fluid. A fan or fans may blow air over the coils of the heat exchanger(s) in order to condition the air. In other embodiments, a chiller and boiler may be utilized to cool and heat water, and the above-described fan or fans may blow air over, for example, a conduit which receives the temperature-controlled water. The air may then be routed toward a space, through ductwork, for example, to condition the space.

Traditional diffusers may distribute the conditioned air to and through the space being conditioned. Unfortunately, traditional diffusers may inefficiently distribute the conditioned air to the space being conditioned. Further, assembly and installation processes of traditional diffusers may be cumbersome and expensive. Further still, traditional diffusers may include expensive and/or an excessive number of parts. Thus, improved diffusers are desired.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In a first embodiment, a plenum slot diffuser includes a plenum box having five walls formed by joining edges of a C-shaped bracket having first, second, and third walls of the five walls with additional edges of an L-shaped bracket having fourth and fifth walls of the fives walls. An air input opening of the plenum box is disposed in one of the five walls and is configured to be coupled to a duct, and an open end of the plenum box defines an air output opening.

In a second embodiment, a plenum slot diffuser includes a plenum box formed by joining edges of a C-shaped bracket with additional edges of an L-shaped bracket such that an open end of the plenum box defines an air output opening. The plenum slot diffuser also includes a blade assembly disposed in the air output opening and configured to diffuse an air flow from the plenum box therethrough, wherein the blade assembly includes a blade holding rod and a blade slidably engaged with a groove of the blade holding rod.

In a third embodiment, a diffuser for a heating, ventilation, and/or air conditioning (HVAC) system includes a blade assembly. The blade assembly includes a blade holding rod having a neck, an arm defining a groove in the blade holding rod between the arm and the neck, and an additional arm defining an additional groove in the blade holding rod between the additional arm and the neck. The blade assembly also includes a blade extending into the groove, and an additional blade extending into the additional groove. Further, the blade assembly includes a clip having a ridge received by the groove, such that the ridge is positioned between the blade and the neck of the blade holding rod, and having an additional ridge received by the additional groove, such that the additional ridge is positioned between the additional blade and the neck of the blade holding rod.

DETAILED DESCRIPTION

The present disclosure is generally directed toward a heating, ventilation, and/or air conditioning (HVAC) system, and more particularly toward a diffuser or duct outlet of the HVAC system.

A wide range of applications exist for HVAC systems. For example, residential, light commercial, commercial, and industrial systems are used to control temperatures and air quality in residences and buildings. Generally, HVAC systems may circulate a fluid, such as a refrigerant, through a closed loop between an evaporator coil, where the fluid absorbs heat, and a condenser, where the fluid releases heat. A fan or fans may blow air over the coils of the heat exchanger(s) in order to condition the air. In other embodiments, a chiller and boiler may be utilized to cool and heat water, and the above-described fan or fans may blow air over, for example, a conduit which receives the temperature controlled water. The air may then be routed toward a space, through ductwork, for example, to condition the space.

Traditional diffusers may distribute the conditioned air to and through the space being conditioned. However, traditional diffusers may inefficiently distribute the conditioned air to the space being conditioned by the HVAC system. Further, assembly and installation processes of traditional diffusers may be cumbersome and expensive. Further still, traditional diffusers may include expensive and/or an excessive number of parts. Thus, improved diffusers are desired.

In accordance with present embodiments, a diffuser includes one or more screw-less assemblies having a reduced part count and configured to provide improved air distribution, as compared to traditional embodiments. Components of the diffuser include a plenum box or plenum box configured to receive the conditioned air, one or more blade assemblies configured to direct the conditioned air from the plenum box to the conditioned space, and a T-bar assembly configured to mount the one or more blade assemblies to the plenum box and/or facilitate other mounting features. The blade assembly may include a blade holding rod, one or more blades slidably engaged with the blade holding rod, and a clip which secures the engagement between the blade holding rod and blade(s). The T-bar assembly may include an upper part and a lower part made of sheet metal, which are slidably engaged with one another. The plenum box may include an L-shaped part and a C-shaped part, which are joined by a clinching process that reduces or eliminates air leakage and may be less expensive than other joining processes, such as welding. In general, the disclosed diffuser features may reduce a cost over traditional embodiments by reducing a part cart and/or reducing manufacturing costs. Further, a performance of the diffuser may be improved over traditional embodiments due to leakage reduction and due to improved diffuser blade adjustment.

These and other features are described in detail below, with reference to the drawings.

Figure 1:
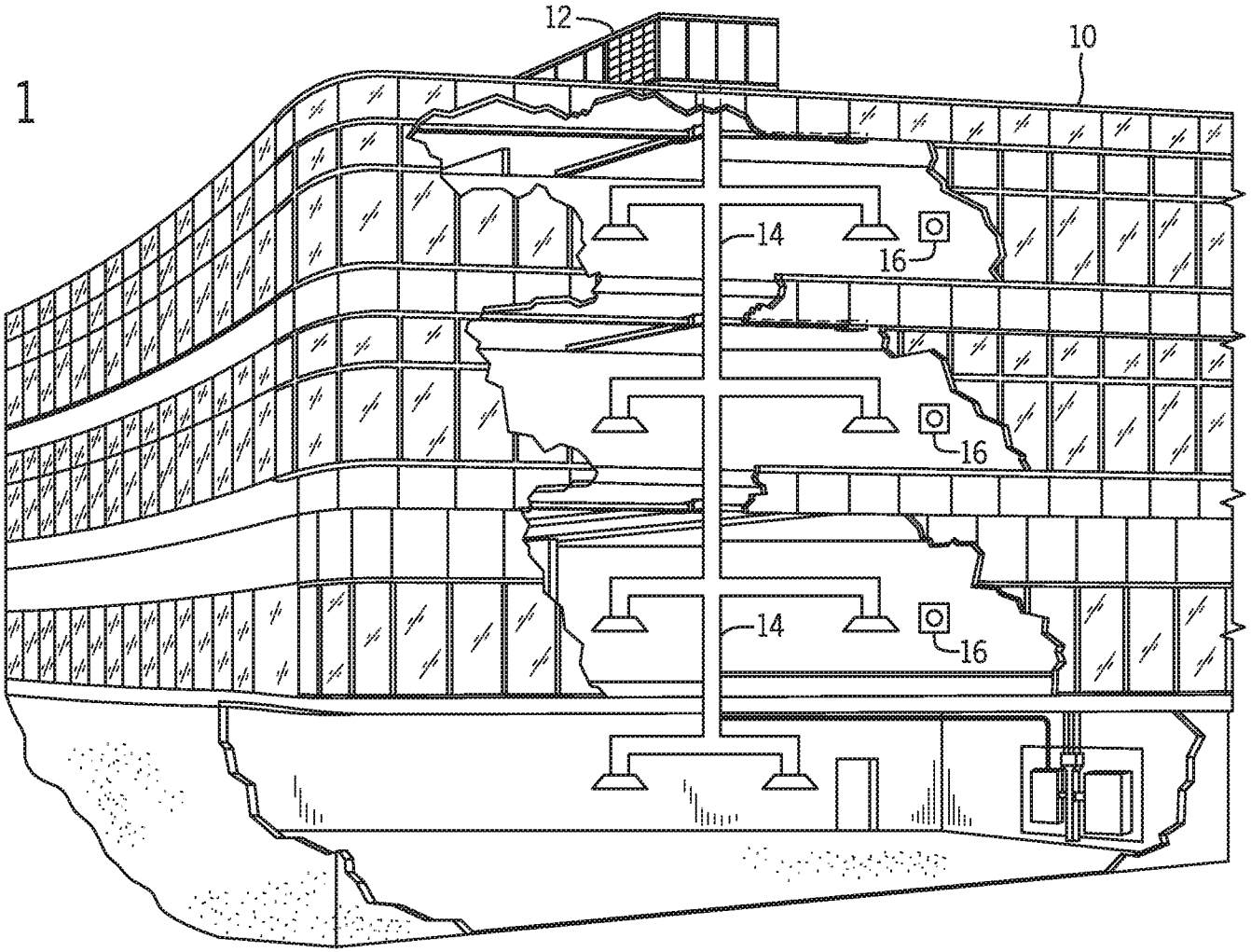
FIG. 1 is a perspective view a heating, ventilation, and/or air conditioning (HVAC) system for building environmental management, in accordance with embodiments described herein.

Turning now to the drawings, FIG. 1 illustrates a heating, ventilation, and/or air conditioning (HVAC) system for building environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single, packaged unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

It should be appreciated that any of the features described herein may be incorporated with the HVAC unit 12, residential heating and cooling systems, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, in accordance with an aspect of the present disclosure, the HVAC unit 12 and corresponding system may include a diffuser configured to distribute air from the ductwork 14 to a conditioned space of the building 10. The diffuser may include one or more screw-less assemblies having a reduced part count and configured to provide improved air distribution compared to traditional diffuser embodiments. For example, components of the diffuser may include a plenum box, configured to receive the conditioned air, one or more blade assemblies configured to direct the conditioned air from the plenum box to the conditioned space, and a T-bar assembly configured to mount the one or more blade assemblies to the plenum box and/or facilitate other mounting features. The blade assembly may include a blade holding rod, one or more blades slidably engaged with the blade holding rod, and a clip which secures the engagement between the blade holding rod and blade(s). The T-bar assembly may include an upper part and a lower part made of sheet metal, which are slidably engaged with one another. The plenum box may include an L-shaped part and a C-shaped part which are joined by a clinching process that reduces or eliminates air leakage therethrough. These and other features are described in detail below, with reference to the drawings.

Figure 2:
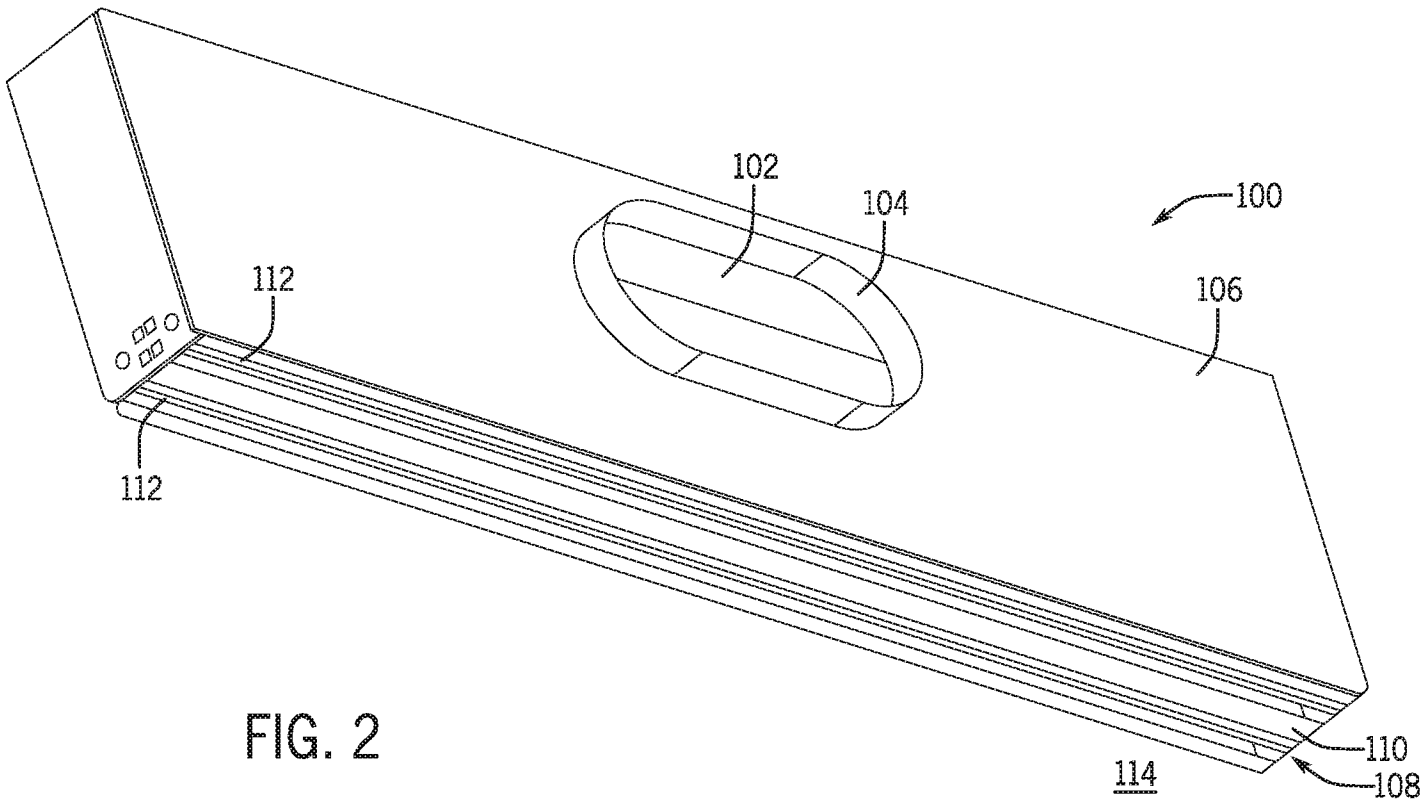
FIG. 2 is a perspective view of a diffuser for use in the HVAC system of FIG. 1, in accordance with embodiments described herein.

FIG. 2 is a perspective view of an embodiment of a diffuser 100 for use in an HVAC system, such as the HVAC system of FIG. 1. The illustrated diffuser 100 is a linear or slot bladed diffuser, although aspects of the present disclosure are also applicable to other bladed diffusers. The diffuser 100 includes an air input opening 102 surrounded by a flange 104. In the illustrated embodiment, the flange 104 is sized and shaped to be received, for example, by ductwork, such as a flexible duct. In particular, the flange 104 includes an elliptical, oval, or circular shape. In some embodiments, an adapter may be disposed between the flange 104 and the ductwork, whereby the adapter facilitates a leak-proof connection between the diffuser 100 and the ductwork.

The diffuser 100 also includes a plenum box 106 in which the air input opening 102 is disposed, and from which the flange 104 extends. A fan or blower may cause an air flow to be passed from the ductwork to the plenum box 106 via the air input opening 102 defined by the flange 104. The plenum box 106 also includes an air output opening 108 which, in the illustrated embodiment, is disposed along a bottom surface of the diffuser 100. The air output opening 108 may open into an external space 114, which receives the air flow from the diffuser 100. A T-bar assembly 110 is disposed across, within, and/or adjacent to the air output opening 108 and between two blade assemblies 112 of the diffuser 100. The T-bar assembly 110 and blade assemblies 112 interact to diffuse and direct an air flow from within the plenum box 106 to the external space 114 to be conditioned by the air flow.

Figure 3:
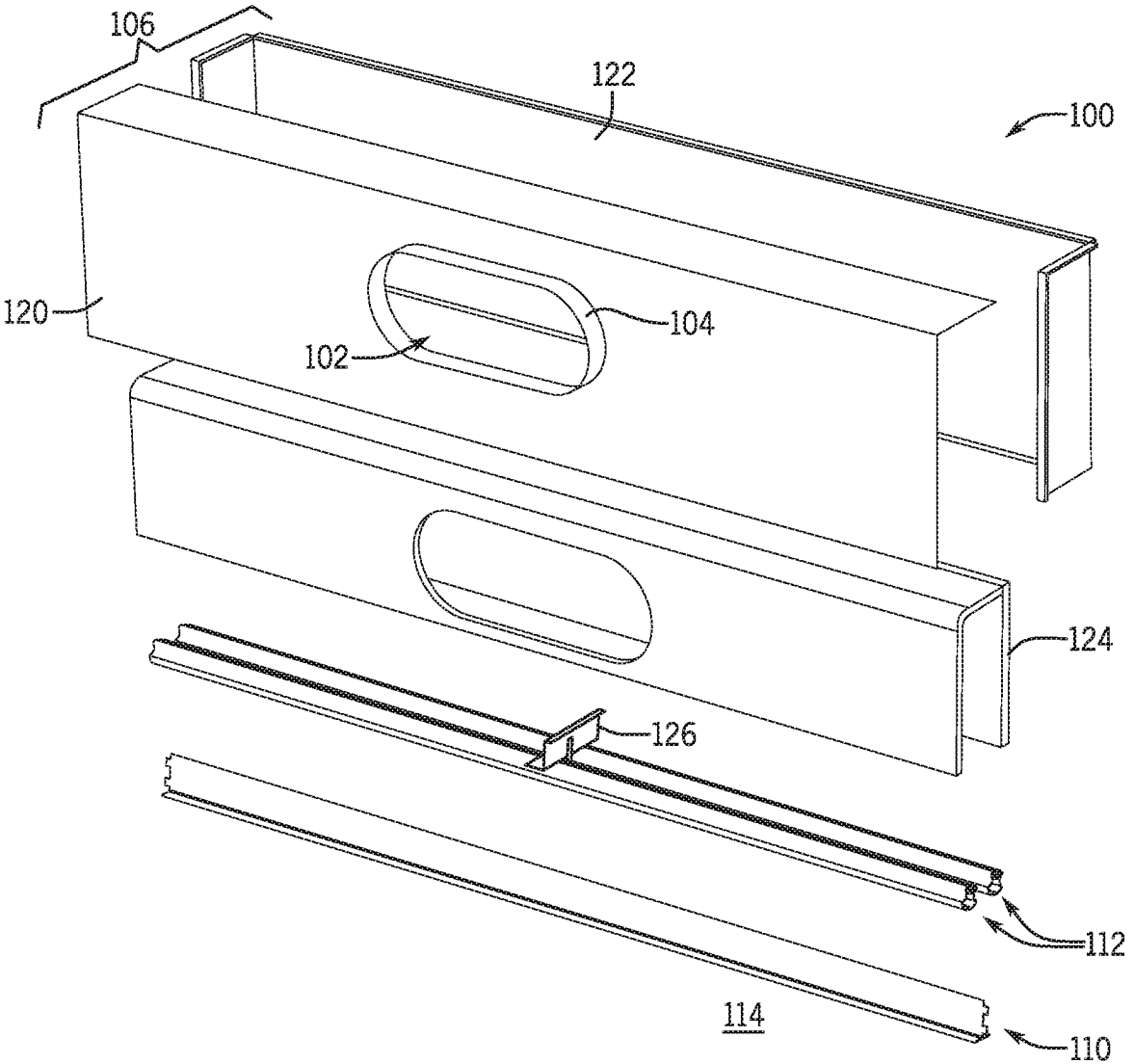
FIG. 3 is an exploded perspective view of the diffuser of FIG. 2, in accordance with embodiments described herein.

FIG. 3 is an exploded perspective view of an embodiment of the diffuser 100 of FIG. 2. As previously described, the diffuser 100 includes the plenum box 106 having the flange 104 and corresponding air input opening 102, the T-bar assembly 110, and the two blade assemblies 112. In the illustrated embodiment, the plenum box 106 is a two-part housing including an L-shaped part 120 and a C-shaped part 122. The L-shaped part 120 and the C-shaped part 122 may be joined by a clinching or crimping process. In other words, the plenum box 106 may include a screw-less assembly and may be joined without a welding process or mechanical fasteners. The clinching process may be less expensive than other joining processes, such as welding and/or fastening, and may reduce or negate air flow leakage compared to such other joining processes. In some embodiments, an insulator 124 may be disposed within the plenum box 106. The insulator 124 may act to insulate an interior of the plenum box 106 from external temperatures, thereby improving temperature control of the air flow distributed from the plenum box 106 and to the external space 114.

As shown, the diffuser 100 includes two blade assemblies 112 and a single T-bar assembly 110. A bracket 126 may extend across and/or couple to the two blade assemblies 112. Additionally or alternatively, the bracket 126 may be coupled to the T-bar assembly 110. For example, the T-bar assembly 110 may include a portion disposed between the two blade assemblies 112, where the portion of the T-bar assembly 110 may couple to the bracket 126. Detailed aspects of the blade assembly 112 and T-bar assembly 110 are described below, with reference to later drawings.

Figure 4:
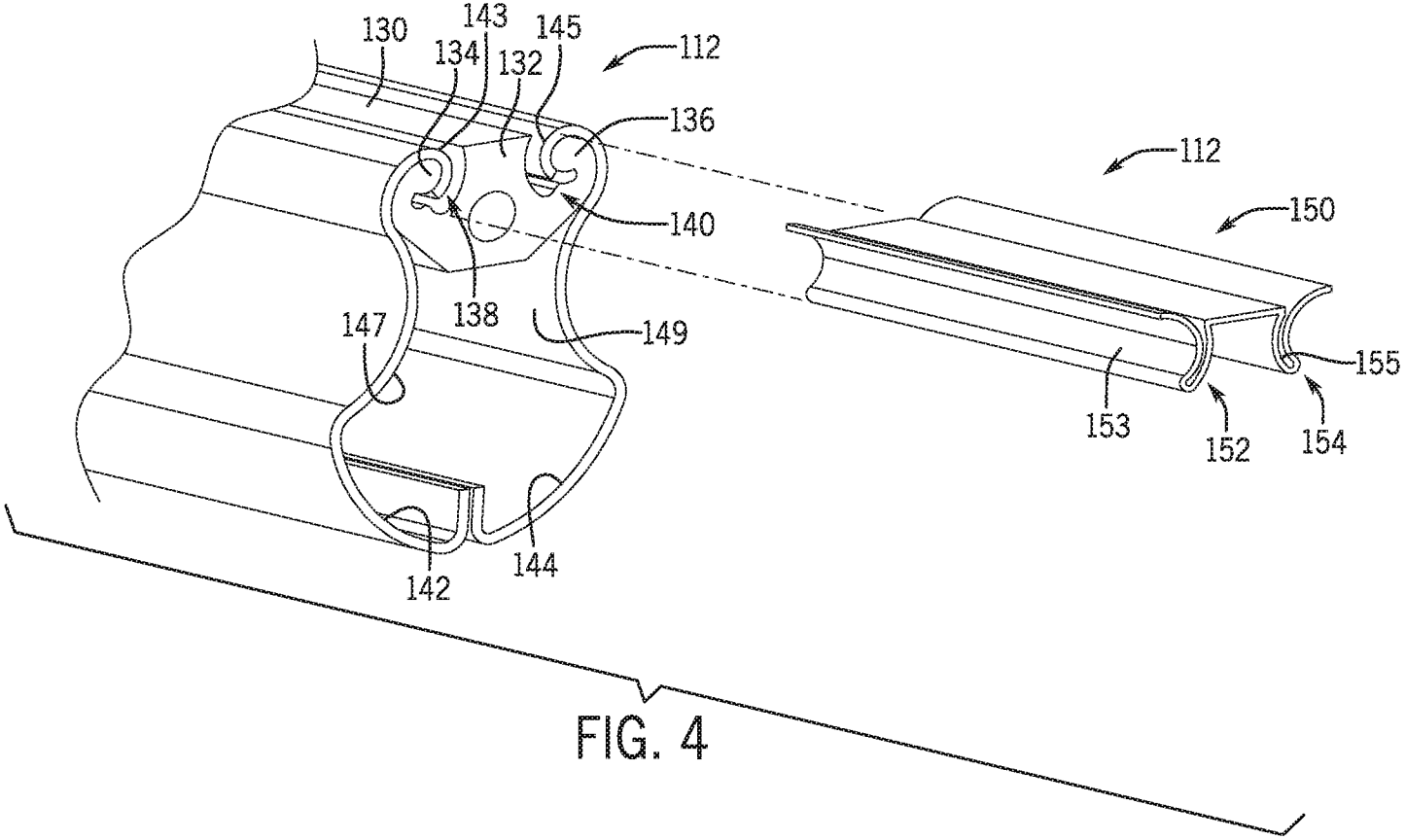
FIG. 4 is an exploded perspective view of a blade assembly of the diffuser of FIG. 2, in accordance with embodiments described herein.

FIG. 4 is an exploded view of one of the blade assemblies 112 of the diffuser 100 of FIG. 2, in accordance with embodiments described herein. The blade assembly 112 includes a blade holding rod 130 having a neck 132, a first arm 134 extending outwardly from the neck 132, and a second arm 136 extending outwardly from the neck 132. Grooves 138, 140 are defined between the neck 132 and the first and second arms 134, 136, respectively. The grooves 138, 140 are configured to receive corresponding blades 142, 144 of the blade assembly 112. In particular, the grooves 138, 140 are configured to receive curvilinear hooks 143, 145 of the corresponding blades 142, 144, respectively. A curvature of the curvilinear hooks 143, 145 may correspond to a curvature of the grooves 138, 140, respectively. Inward facing surfaces 147, 149 of the corresponding blades 142, 144 may contact, or face, the first and second arms 134, 136 of the blade holding rod 130. As shown, the grooves 138, 140 may include a clearance and/or a curvature sufficient to enable the corresponding blades 142, 144 to move therein. For example, the first blade 142 may be rotatable about the first arm 134 and within the groove 138, while the second blade 144 may be rotatable about the second arm 136 and within the second groove 140. Accordingly, the blades 142, 144 may be adjusted to change diffuser effects imparted to the air flow adjacent the blades 142, 144 and exiting the diffuser 100. For example, the blades 142, 144 may be manually adjusted or may be automatically adjusted by the air flow passing over the blades 142, 144. As shown, each blade 142, 144 may include a curvilinear profile extending from the curvilinear hooks 143, 145 toward a location underneath the blade holding rod 130. The blades 142, 144 may be rotatable such that the blades 142, 144 contact each other, or come into close proximity with each other underneath the blade holding rod 130. A performance of the disclosed diffuser may be improved over traditional embodiments due to improved diffuser blade adjustment, via the sliding and rotating features described above.

In the illustrated embodiment, a clip 150 may also include features, such as ridges 152, 154, which slide into the corresponding grooves 138, 140 of the blade holding rod 130. In some embodiments, a curvature and/or a clearance of the grooves 138, 140 may be configured to also receive the ridges 152, 154, respectively, of the clip 150. The ridges 152, 154 may include outward facing surfaces 153, 155, respectively, which contact and/or face the blades 142, 144 engaged with the blade holding rod 130 via the grooves 138, 140. The outward facing surfaces 153, 155 may each include a U-shape or partial spiral or snail shape, as shown, to conform to the shape of the corresponding grooves 138, 140. The clip 150 is slidable into the grooves 138, 140, for example, in order to retain the corresponding blades 142, 144 within the grooves 138, 140, while also enabling the above-described rotation of the corresponding blades 142, 144 relative to the blade holding rod 130. The slidable engagement enables a screw-less assembly of the blade assembly 112, which improves an assembly process and reduces a cost of the diffuser 100.

Figure 5:
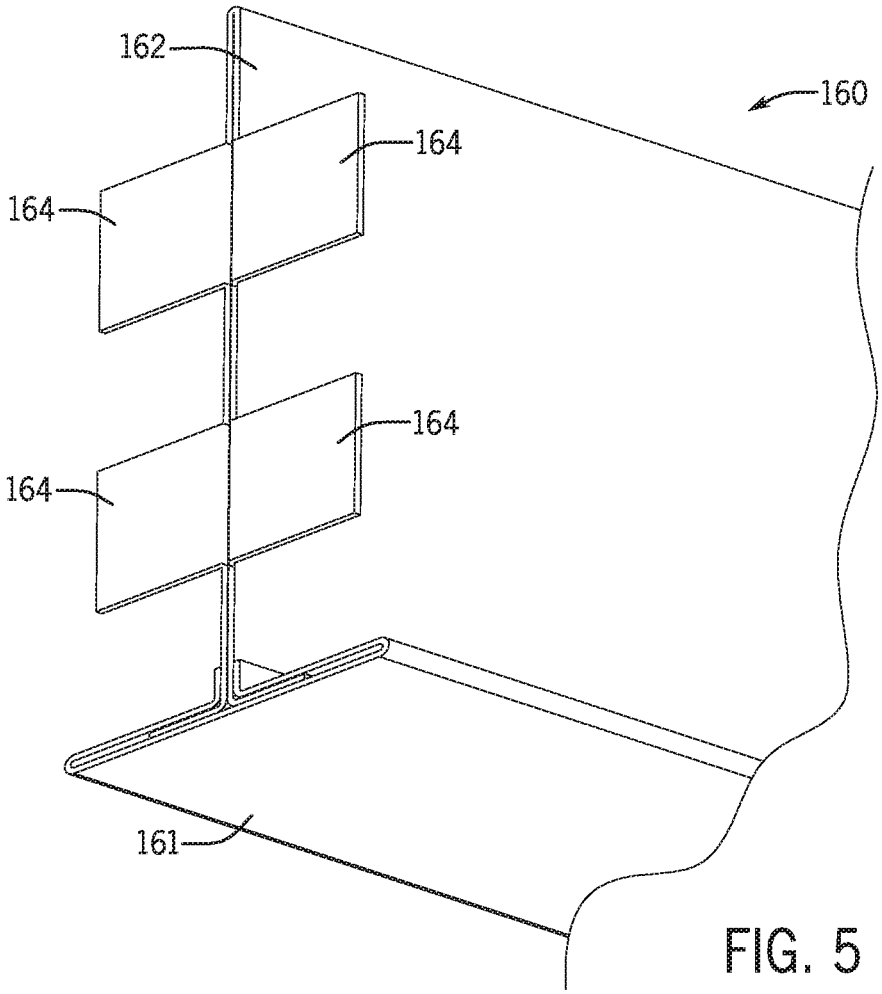
FIG. 5 is a perspective view of a T-bar assembly of the diffuser of FIG. 2, in accordance with embodiments described herein.

FIG. 5 is a perspective view of a T-bar assembly 160, such as T-bar assembly 110 mentioned above, for use in the diffuser 100 of FIG. 2, in accordance with embodiments described herein. The T-bar assembly 160 may include a first part 161, sometimes referred to as a lower part depending on the arrangement of the diffuser 100, and a second part 162, sometimes referred to as an upper part depending on the arrangement of the diffuser 100. Brackets 164 may be disposed across the T-bar assembly 160 in order to facilitate coupling of the T-bar assembly 160 to, for example, the plenum box (not shown in FIG. 5). However, components of the T-bar assembly 160 itself may be joined without welding or fasteners.

Figure 6:
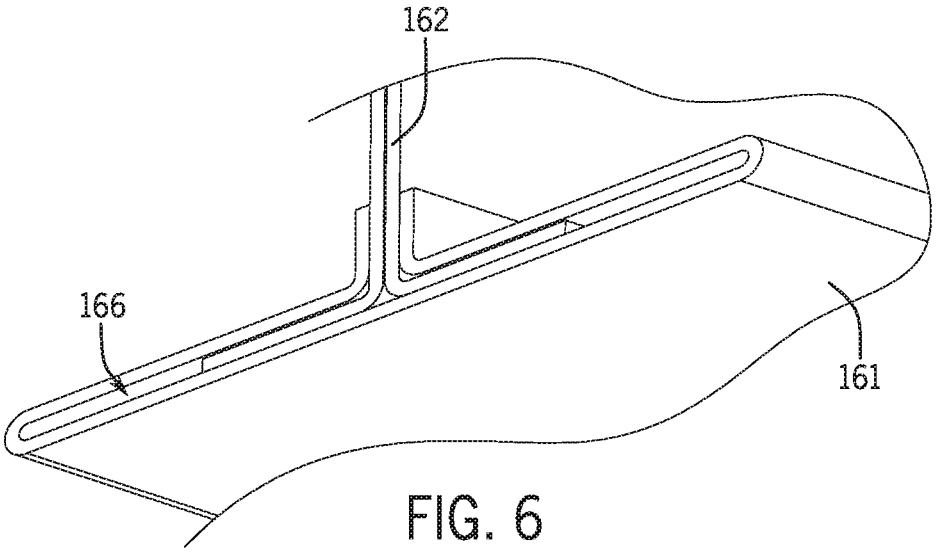
FIG. 6 is a perspective view of a portion of the T-bar assembly of FIG. 5, in accordance with embodiments described herein.

FIG. 6 is a perspective view of an embodiment of a portion of the T-bar assembly 160 of FIG. 5. As previously described, the T-bar assembly 160 includes the first part 161, or lower part, and the second part 162, or upper part. As shown, the first part 161 may form a cavity 166 configured to receive the second part 162. In some embodiments, the first part 161 and the second part 162 may be formed by sheet metal, and the first part 161 may slidably engage with the second part 162 to assemble the T-bar assembly 160. Thus, manufacturing and assembly of the T-bar assembly 160 is simplified over traditional embodiments.

Figure 7:
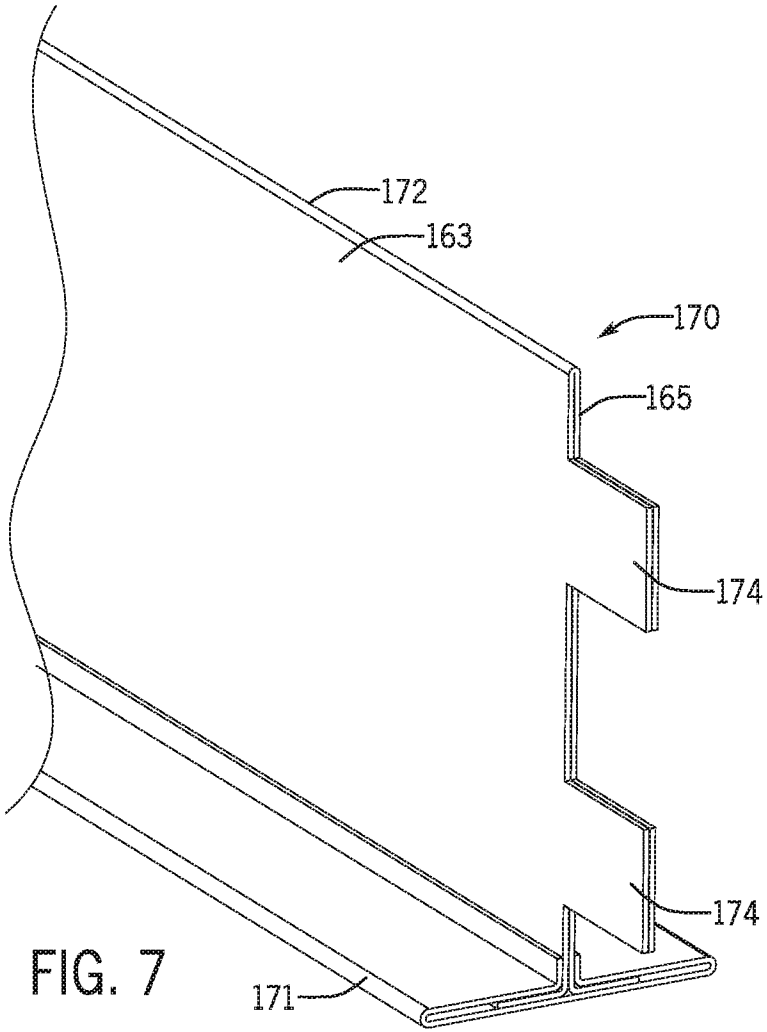
FIG. 7 is a perspective view of a T-bar assembly of the diffuser of FIG. 2, in accordance with embodiments described herein.

FIG. 7 is a perspective view of an embodiment of a T-bar assembly 170 for use in the diffuser 100 of FIG. 2. The T-bar assembly 170 in FIG. 7 includes a lower part 171 and an upper part 172 joined to form a T-shape configuration. Extensions 174 may extend from an edge 165 of the upper part 172. The extensions 174 may be flush with a longitudinal surface 163 of the upper part 172 and may extend, for example, through slots in the plenum box (not show in FIG. 7) to enable coupling of the T-bar assembly 170 to the plenum box (not shown in FIG. 7). The extensions 174 are rectangular in the illustrated embodiment but may be some other shape in other embodiments, such as triangular, semicircular, or some combination thereof. It should be noted that both the upper part 172 and the lower part 171 may be formed by sheet metal.

Figure 8:
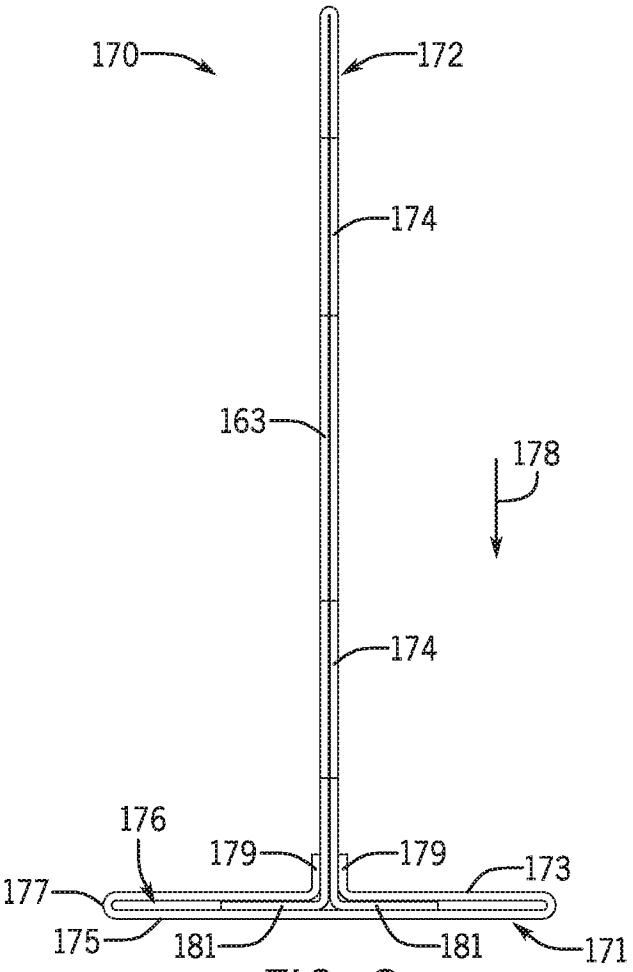
FIG. 8 is an axial side view of the T-bar assembly of FIG. 7, in accordance with embodiments described herein.

FIG. 8 is a side view of the T-bar assembly 170 of FIG. 7, in accordance with embodiments described herein. The lower part 171 of the T-bar assembly 170 may include a cavity 176 which receives the upper part 172 of the T-bar assembly 170. The lower part 171 may include, for example, sheet metal forming a first layer 173 and a second layer 175 connected by a folded edge 177, where the cavity 176 is formed between the first layer 173 and the second layer 175 and is sized and shaped to receive the upper part 172 of the T-bar assembly 170. The lower part 171 may also include flanges 179 extending upwardly or outwardly from the first layer 173 to facilitate retention of the upper part 172 of the T-bar assembly 170 in the cavity 176. Further, the upper part 172 may be generally vertical, as shown, but may include horizontal flanges 181 extending in the cavity 176 formed by the lower part 171. Thus, as illustrated in FIG. 8, a downward force 178 against the lower part 171 of the T-bar assembly 170 may not cause separation of the lower part 171 from the upper part 172 due to the overlap between the flanges 181 of the upper part 172 and the first surface 173 of the lower part 171.

Figure 9:
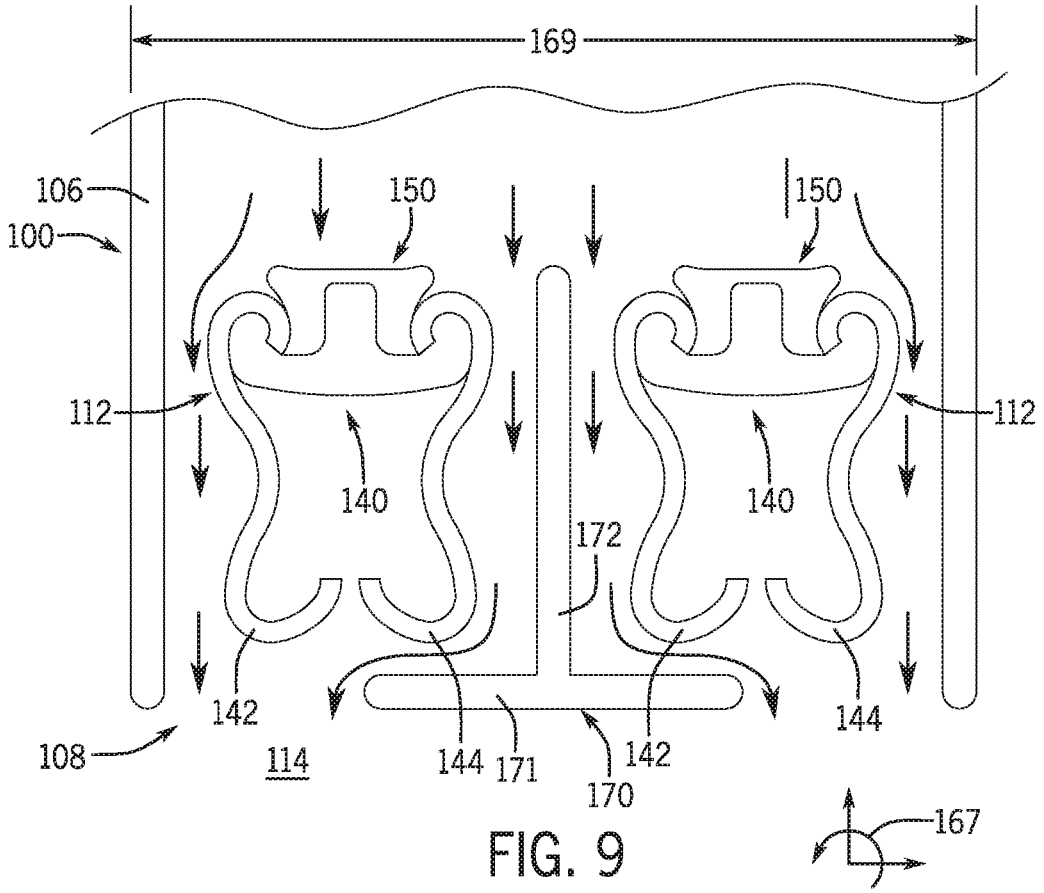
FIG. 9 is a schematic cross-sectional axial view of the diffuser of FIG. 2 having two blade assemblies and a T-bar assembly disposed between the two blade assemblies, in accordance with embodiments described herein.

FIG. 9 is a schematic cross-sectional axial view of an embodiment of the diffuser 100 of FIG. 2 having two blade assemblies 112 and the T-bar assembly 170 disposed between the two blade assemblies 112. In the illustrated embodiment, the diffuser 100 includes the plenum box 106 in which the two blade assemblies 112 and the T-bar assembly 170 are disposed. The plenum box 106 includes a depth 169 suitable for positioning the two blade assemblies 112 and the T-bar assembly 170 in the air output opening 108 of the plenum box 106. However, in another embodiment, the depth 169 may be greater than or less than is shown, and a different number of blade assemblies 112 and/or T-bar assemblies 170 may be disposed in, or adjacent to, the air output opening 108. For example, one embodiment may include a greater depth 169, such that the diffuser 100 includes two T-bar assemblies 170 and three blade assemblies 112. As shown, the air flow may travel from the plenum box 106 and out through the air output opening 108, into the conditioned space 114. As previously described, the blades 142, 144 of each blade assembly 112 may be curved and positioned to diffuse the air flow through the air output opening 108. The blades 142, 144 may be slidably engaged and/or rotatably engaged with the blade holding rod 150, as previously described. For example, the blades 142, 114 may be rotatable in a circumferential direction 167 to adjust a position of the blades 142, 144 with respect to the incoming air flow. In general, the blades 142, 144 may be manually adjustable, based for example on seasonal changes, and/or may be adjusted by forces exerted thereon by the incoming air flow.

Figure 10:
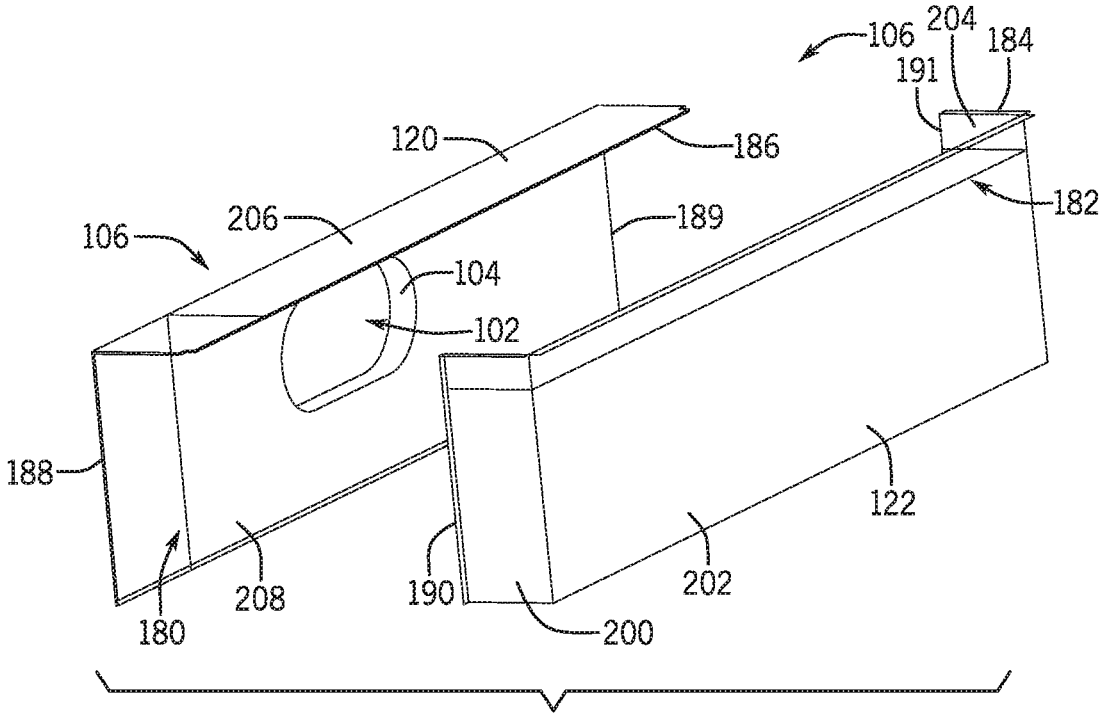
FIG. 10 is an exploded perspective view of a two-part plenum box of the diffuser of FIG. 2, in accordance with embodiments described herein.
Figure 11:
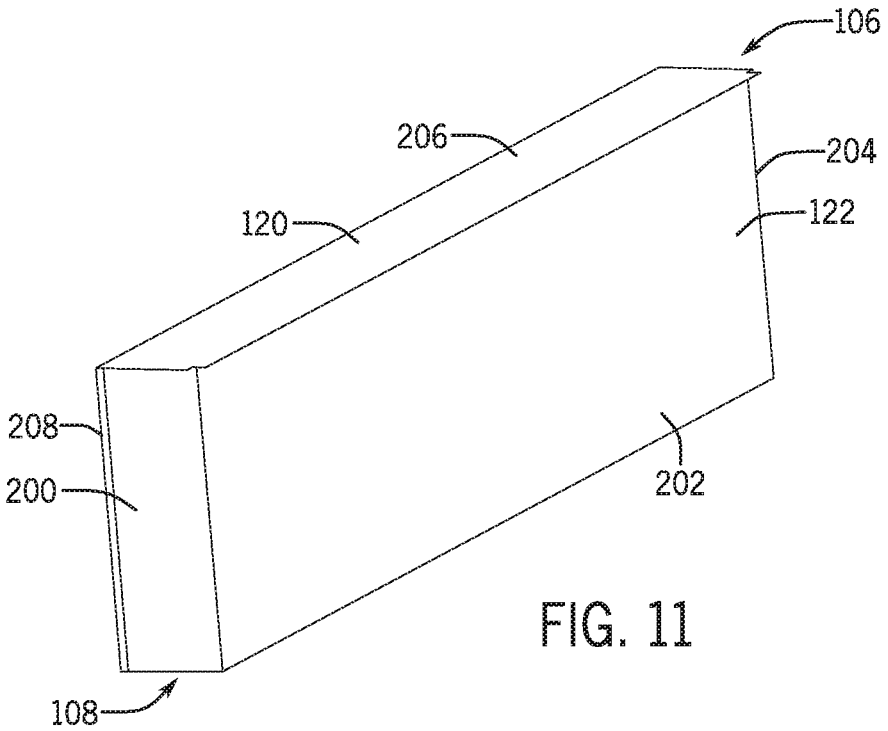
FIG. 11 is a perspective view of the two-part plenum box of FIG. 7, in accordance with embodiments described herein.

FIG. 10 is an exploded perspective view of the plenum box 106 of the diffuser 100, in accordance with embodiments described herein. The illustrated plenum box 106 is a two-part body having a first part, which may be referred to as the L-shaped part 120, and a second part, which may be referred to as the C-shaped part 122. The L-shaped part 120 includes an L-shaped cross-section 180, and the C-shaped part 122 includes a C-shaped cross-section 182. In the illustrated embodiment, the L-shaped part 120 includes the air input opening 102 and the corresponding flange 104. In another embodiment, the C-shaped part 122 may include the air input opening 102 and the corresponding flange 104. In general, the C-shaped part 122 includes a first wall 200, a second wall 202, and a third wall 204, and the L-shaped part 120 includes a fourth wall 206 and a fifth wall 208. Thus, when joined together, the plenum box 106 includes five walls 200, 202, 204, 206, 208, and the air output opening (shown in FIG. 2) is formed along an open end of the plenum box 106. As previously described, the L-shaped part 120 and the C-shaped part 122 may be joined by a clinching or crimping process, as opposed to screws or welding, which simplifies the manufacturing and assembly process. For example, a C-shaped upper edge 184 of the C-shaped part 122 may be crimped or clinched together with an edge 186 of the L-shaped part 120. Further, L-shaped edges 188, 189 of the L-shaped part 120 may be crimped or clinched together with edges 190, 191, respectively, of the C-shaped part 122. FIG. 11 is a perspective view of the two-part plenum box 106 of FIG. 10 following assembly, illustrating the L-shaped part 120 and the C-shaped part 122 in a crimped or clinched engagement. That is, the walls 200, 202, 204 of the C-shaped part 122 and the walls 206, 208 of the L-shaped part 120 form the plenum box 106, and the air output opening 108 is formed along an open bottom end of the plenum box 106.

The disclosed diffuser features may reduce a cost over traditional embodiments by reducing a part cart and/or reducing manufacturing costs. Further, a performance of the diffuser may be improved over traditional embodiments due to leakage reduction and due to an improved ability to adjust diffuser blades.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A plenum slot diffuser comprising:

a plenum box comprising a C-shaped bracket defining first, second, and third walls of the plenum box, and comprising-an L-shaped bracket defining fourth and fifth walls of the plenum box , wherein wall edges of the C-shaped bracket are coupled with additional wall edges of the L-shaped bracket such that the plenum box comprises five walls, wherein an air input opening of the plenum slot diffuser is disposed in the fourth wall or the fifth wall corresponding to the L-shaped bracket and is configured to be coupled to a duct, and wherein an air output opening of the plenum slot diffuser is defined by the first, second, and third walls corresponding to the C-shaped bracket and the fifth wall corresponding to the L-shaped bracket; and a blade holding rod having a neck, an arm defining a groove in the blade holding rod between the arm and the neck, and an additional arm defining an additional groove in the blade holding rod between the additional arm and the neck, wherein the neck, the groove, and the additional groove face away from the air output opening of the plenum box;

a blade having a proximal end extending into the groove and a distal end extending toward the air output opening;

an additional blade having an additional proximal end extending into the additional groove and an additional distal end extending toward the air output opening; and a clip having a ridge received by the groove, such that the ridge is positioned between the blade and the neck of the blade holding rod, and having an additional ridge received by the additional groove, such that the additional ridge is positioned between the additional blade and the neck of the blade holding rod.

2. The plenum slot diffuser of claim 1, wherein the wall edges of the C-shaped bracket and the additional wall edges of the L-shaped bracket are clinched or crimped together.

3. The plenum slot diffuser of claim 1, wherein the air input opening is disposed in the fifth wall corresponding to the L-shaped bracket.

4. The plenum slot diffuser of claim 1, wherein:

the proximal end of the blade extends into the groove of the blade holding rod, and the ridge of the clip is received by the groove of the blade holding rod, such that the proximal end of the blade is retained in the groove without a screw; and the additional proximal end of the additional blade extends into the additional groove of the blade holding rod, and the additional ridge of the clip is received by the additional groove of the blade holding rod, such that the additional proximal end of the additional blade is retained in the additional groove without an additional screw.

5. The plenum slot diffuser of claim 1, comprising:

a blade assembly disposed in the air output opening, and configured to diffuse an air flow passing from the plenum box through the air output opening;

an additional blade assembly disposed in the air output opening and configured to diffuse the air flow passing from the plenum box through the air output opening; and a T-bar assembly disposed between the blade assembly and the additional blade assembly.

6. The plenum slot diffuser of claim 5, comprising a bracket configured to be coupled to the T-bar assembly, to the blade assembly, and to the additional blade assembly.

7. The plenum slot diffuser of claim 5, wherein the blade assembly comprises:

a blade holding rod having a first groove and a second groove;

a first blade slidably engaged with the first groove and a second blade slidably engaged with the second groove; and a clip slidably engaged with the first groove and the second groove.

8. The plenum slot diffuser of claim 7, wherein the first blade is rotatably engaged with the first groove such that a first position of the first blade is adjustable by rotating the first blade within the first groove, and wherein the second blade is rotatably engaged with the second groove such that a second position of the second blade is adjustable by rotating the second blade within the second groove.

9. A plenum slot diffuser comprising:

a plenum box comprising a C-shaped bracket and an L-shaped bracket, wherein wall edges of the C-shaped bracket are coupled with additional wall edges of the L-shaped bracket to define five walls of the plenum box and such that the C-shaped bracket and the L-shaped bracket together define an air output opening of the plenum slot diffuser; and a blade assembly disposed in the air output opening and configured to diffuse an air flow from the plenum box therethrough, wherein the blade assembly comprises a blade holding rod and a blade slidably engaged with a groove of the blade holding rod; wherein:

the blade holding rod includes a neck, an arm defining the groove in the blade holding rod between the arm and the neck, and an additional arm defining an additional groove in the blade holding rod between the additional arm and the neck, wherein the neck, the groove, and the additional groove face away from the air output opening of the plenum box, wherein the blade includes a proximal end extending into the groove and a distal end extending toward the air output opening, and wherein an additional blade includes an additional proximal end extending into the additional groove and an additional distal end extending toward the air output opening; and the blade assembly comprises a clip having a ridge received by the groove, such that the ridge is positioned between the blade and the neck of the blade holding rod, and having an additional ridge received by the additional groove, such that the additional ridge is positioned between the additional blade and the neck of the blade holding rod.

10. The plenum slot diffuser of claim 9, wherein the C-shaped bracket comprises first, second, and third walls of the plenum box, wherein the L-shaped bracket comprises fourth and fifth walls of the plenum box, and wherein the air output opening is defined by the first, second, third, and fifth walls.

11. The plenum slot diffuser of claim 9, comprising an air input opening disposed in the fifth wall corresponding to the L-shaped bracket, wherein the air input opening is configured to be coupled to a duct.

12. The plenum slot diffuser of claim 9, wherein the blade assembly comprises an additional blade slidably engaged with an additional groove of the blade holding rod.

13. The plenum slot diffuser of claim 9, comprising:

an additional blade assembly having an additional blade holding rod and an additional blade disposed in an additional groove of the additional blade holding rod; and a T-bar assembly disposed between the blade assembly and the additional blade assembly.

14. The plenum slot diffuser of claim 9, wherein the proximal end of the blade extends into the groove of the blade holding rod, and the ridge of the clip is received by the groove of the blade holding rod, such that the proximal end of the blade is retained in the groove without a screw; and the additional proximal end of the additional blade extends into the additional groove of the blade holding rod, and the additional ridge of the clip is received by the additional groove of the blade holding rod, such that the additional proximal end of the additional blade is retained in the additional groove without an additional screw.

15. A diffuser for a heating, ventilation, and/or air conditioning (HVAC) system, the diffuser comprising a plenum box having an air output opening, and the diffuser comprising a blade assembly disposed in the plenum box adjacent to the air output opening, wherein the blade assembly includes:

a blade holding rod having a neck, an arm defining a groove in the blade holding rod between the arm and the neck, and an additional arm defining an additional groove in the blade holding rod between the additional arm and the neck, wherein the neck, the groove, and the additional groove face away from the air output opening of the plenum box;

a blade having a proximal end extending into the groove and a distal end extending toward the air output opening, wherein the blade comprises a curvilinear profile extending from the proximal end at the groove, around an outside of the arm, and to the distal end adjacent the air output opening;

an additional blade having an additional proximal end extending into the additional groove and an additional distal end extending toward the air output opening, wherein the additional blade comprises an additional curvilinear profile extending from the additional proximal end at the groove, around an additional outside of the additional arm, and to the additional distal end adjacent the air output opening: and a clip having a ridge received by the groove, such that the ridge is positioned between the blade and the neck of the blade holding rod, and having an additional ridge received by the additional groove, such that the additional ridge is positioned between the additional blade and the neck of the blade holding rod.

16. The diffuser of claim 15, wherein the ridge includes an outward facing surface contacting the blade, and wherein the additional ridge includes an additional outward facing surface contacting the additional blade.

17. The diffuser of claim 15, wherein the plenum box includes an air input opening.

18. The diffuser of claim 15, wherein the plenum box comprises:

an air input opening; and a C-shaped part and an L-shaped part crimped or clinched with the C-shaped part to form a plenum, wherein the plenum is configured to receive an air flow from the air input opening, and wherein the air output opening is configured to receive the air flow from the plenum and output the air flow from the plenum box.

19. The diffuser of claim 15, wherein the plenum box includes a flange disposed about and defining an air input opening, and wherein the flange is configured to be coupled to ductwork or to a duct adapter.

20. The diffuser of claim 15, comprising an insulator disposed within the plenum box.

21. The diffuser of claim 15, comprising:

a T-bar assembly disposed in the plenum box adjacent to the air output opening; and a bracket disposed in the plenum box adjacent to the air output opening, wherein the bracket is coupled to the T-bar assembly, to the blade assembly, or both.

22. The diffuser of claim 15, comprising an additional blade assembly having an additional blade holding rod, a third blade, a fourth blade, and an additional clip, wherein the additional blade assembly is disposed in the plenum box adjacent to the air output opening.

23. The diffuser of claim 15, wherein the clip comprises:

a first spiral-shaped surface received by the groove; and an additional spiral-shaped surface received by the additional groove.

24. The diffuser of claim 15, wherein:

the proximal end of the blade extends into the groove of the blade holding rod, and the ridge of the clip is received by the groove of the blade holding rod, such that the proximal end of the blade is retained in the groove without a screw; and the additional proximal end of the additional blade extends into the additional groove of the blade holding rod, and the additional ridge of the clip is received by the additional groove of the blade holding rod, such that the additional proximal end of the additional blade is retained in the additional groove without an additional screw.

* * * * *